US005232067A

United States Patent [19]

Griffith

[11] Patent Number: 5,232,067

[45] Date of Patent: Aug. 3, 1993

[54] STILE EXTENDING ATTACHMENT FOR LADDER

[76] Inventor: Leon E. Griffith, P.O. Box 835, St. Thomas, V.I. 00804

[21] Appl. No.: 627,202

[22] Filed: Dec. 13, 1990

[51] Int. Cl.[5] ..... E06C 7/44

[52] U.S. Cl. ..... 182/201

[58] Field of Search ..... 182/201, 204, 107, 205, 182/200, 214, 203

[56] References Cited

U.S. PATENT DOCUMENTS

| | | | |
|---|---|---|---|
| 1,346,831 | 7/1920 | Lehmann | 182/201 |
| 1,609,257 | 11/1926 | Lazear | 182/205 |
| 1,751,173 | 3/1930 | Rice | 182/205 |
| 2,249,304 | 7/1941 | Wilson | 182/201 |
| 3,428,147 | 2/1969 | Gordon | 182/204 |
| 3,998,293 | 12/1976 | Raia | 182/204 |
| 4,676,342 | 6/1987 | Godde | 182/201 |
| 4,787,478 | 11/1988 | Stakes | 182/214 |

FOREIGN PATENT DOCUMENTS

| | | | |
|---|---|---|---|
| 44660 | 10/1908 | Switzerland | 182/201 |

*Primary Examiner*—Reinaldo P. Machado

[57] ABSTRACT

An attachment device is provided for use with a ladder having two side stile members and a plurality of hollow rungs connected therebetween for extending at least one of said side stile members so that the ladder can be used on uneven ground. The attachment device comprises an elongated member provided with a longitudinal slot extending lengthwise therethrough, and mounting means for adjustably attaching the elongated member to one of the side stile members. The mounting means includes at least one first crossbar adapted to fit through the slot in the elongated member and to extend through one of the hollow rungs and means for securing opposite ends of the at least one first crossbar to the side stile members.

2 Claims, 1 Drawing Sheet

STILE EXTENDING ATTACHMENT FOR LADDER

The present invention relates to ladders and particularly to attachments to be mounted on a ladder to allow use of the ladder on inclined, sloping or uneven surfaces.

BACKGROUND OF THE INVENTION

It has been known in the art to provide various attachments which allow for the extension of at least one leg or stile of a ladder so that the ladder could be used on a sloping or irregular surface, such as a flight of stairs or the side of a hill. In the past, stile extending attachments were constructed such that the ladder had to be manufactured or modified to include special means on the ladder, such as holes drilled in the legs (stiles) of the ladder to enable mounting of the stile extending attachment thereon.

Such prior art ladder stile extending attachments are disclosed, for example, in U.S. Pat. No. 2,249,304 to Wilson or U.S. Pat. No. 2,306,797 to Biery wherein the stile extending attachments are secured to the ladder by bolts which extend through specially designated holes provided in the stiles. Therefore, these prior art attachments could not be mounted on standard ladders which were not provided with special holes adapted for receiving screws for securing a stile extending attachment to the ladder stile.

SUMMARY OF THE INVENTION

It is an object of the present invention to provide a novel ladder stile extending attachment, particularly for use with standard, lightweight ladders provided with hollow rungs.

It is an object of the present invention to provide a ladder stile extending attachment which includes novel means for mounting the attachment to such a ladder without any modification to the ladder structure.

It is another object of this invention to provide a ladder stile extending attachment which is simple in structure and can be easily mounted on a ladder.

It is a further object of the present invention to provide a ladder stile extending attachment made of a lightweight material, so that the attachment can be easily handled.

It is still another object of the present invention to provide an attachment with mounting means which securely and rigidly connects the attachment to the ladder.

The above advantages are achieved by a structure of the present invention stile extending attachment device comprising an elongated member provided with a longitudinal slot extending lengthwise therethrough, and mounting means for adjustably attaching the elongated member to one of the side stiles of the ladder. The mounting means includes at least one crossbar adapted to fit through the slot in the elongated member and to extend through one of the hollow rungs of the ladder and means for securing opposite ends of this crossbar to the opposite side stiles.

The present invention will now be described in more detail with reference to one preferred embodiment shown in the accompanying drawings:

DETAILED DESCRIPTION OF THE PREFERRED EMBODIMENT(S)

Figure 1:
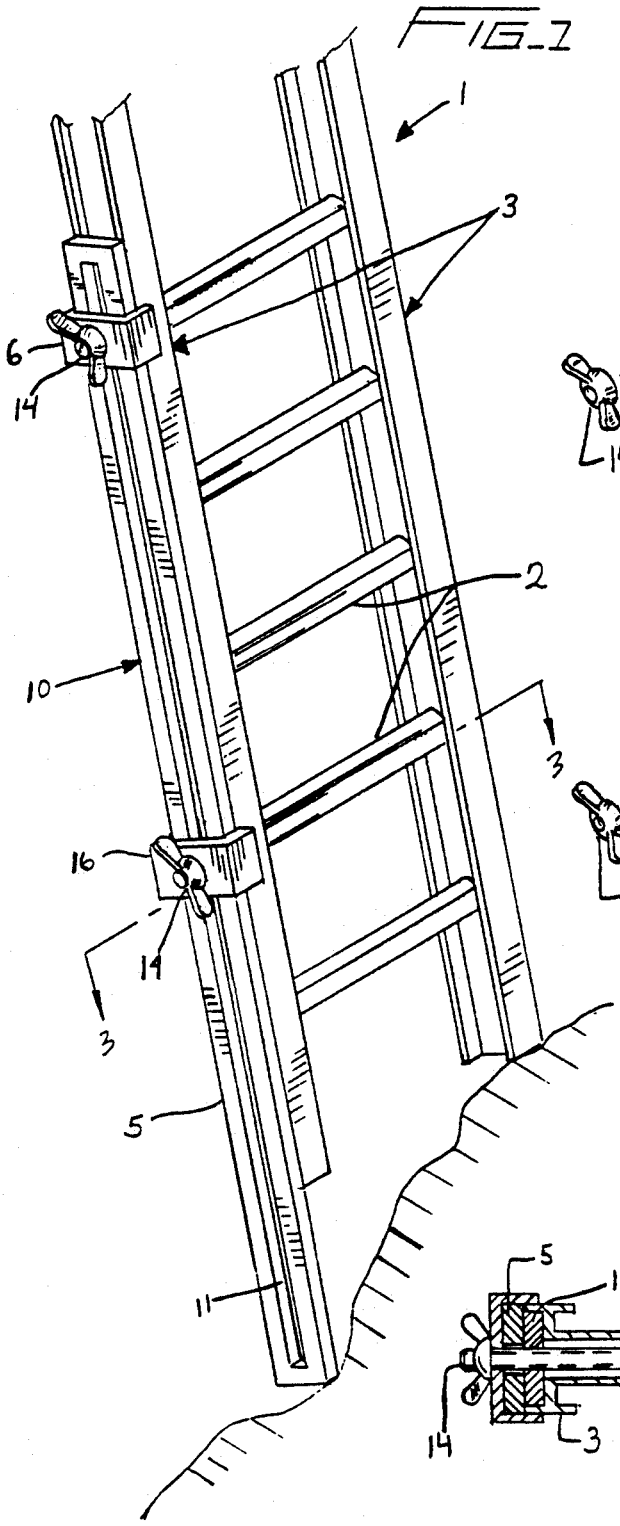
FIG. 1 is a perspective view showing the lower portion of a ladder on an uneven surface equipped with the stile extending attachment in accordance with the present invention.
Figure 2:
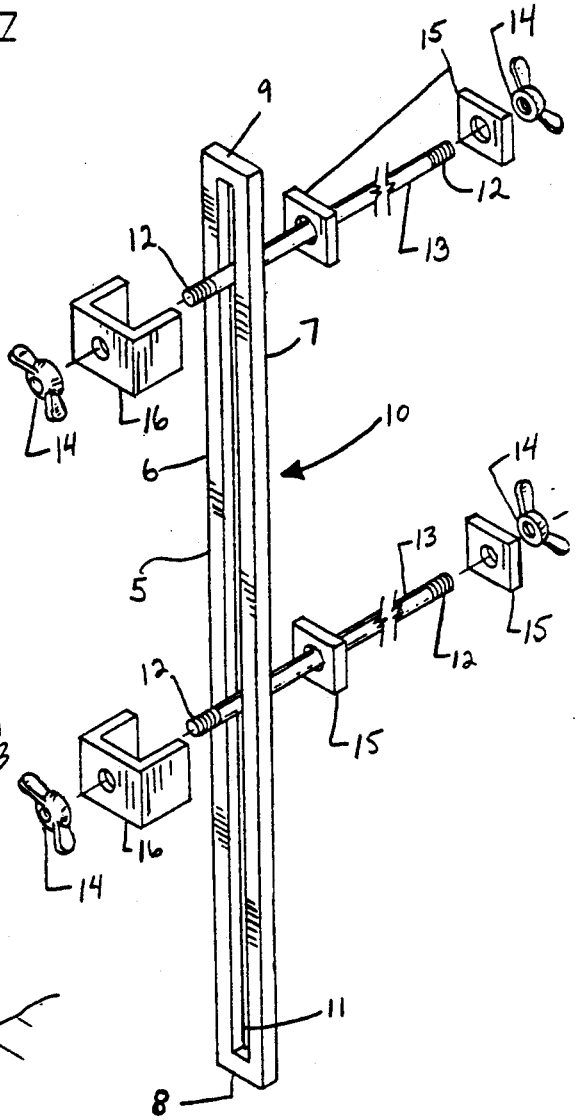
FIG. 2 is a perspective view showing the components of the present invention.
Figure 3:
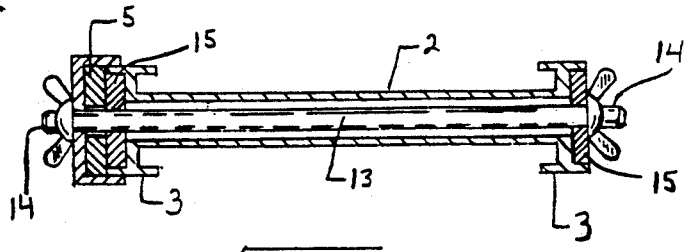
FIG. 3 is a cross-sectional view showing the device attachiing to a ladder.

Referring now to the drawings, and particularly to FIG. 1, there is shown a ladder 1 which includes two side stiles 3 connected by a plurality of rungs 2. The ladder is shown resting on an uneven, sloping surface so as to illustrate use of the present invention. The rungs 2 are of the type found in standard, lightweight ladders available on the market today, having a hollow structure with openings on both ends extending to the outer surface of the side stiles 3. FIG. 1 depicts the present invention stile extending attachment device 10 secured to ladder 1. FIG. 2 illustrates in more detail the separate components of one preferred embodiment of the present invention attachment device. In this preferred embodiment, the stile extending attachment device 10 includes an elongated member 5 which can be made of two spaced apart vertical bars 6, 7 interconnected at their opposite ends by horizontal pieces 8 and 9 so as to form a slot 11 extending lengthwise through the elongated member 5.

Means for connecting the stile extending attachment 10 to the ladder include two crossbars 13. Each crossbar 13 is provided with threads 12 at least at the opposite ends thereof and is dimensioned to fit through the slot 11 in the elongated member 5. The length of the crossbars 13 is selected such that each crossbar 13 extends through the respective rung 2 of the ladder 1, and has opposite threaded ends 12 projecting outside the rungs 2. Therefore, there is no need for special holes for mounting the stile extending attachment to the ladder.

Securing means for securing the attachment 10 to the ladder stiles includes four nuts 14 which are provided to fit over the threaded ends of the crossbars for tightening the elongated member 5 to both side stiles 3 of the ladder 1. Two spacer plates 15 are provided for each crossbar 13. These spacers can be fitted over the threaded ends of the crossbars 13 and positioned against the outer sides of the side stiles. The elongated member is insertable over the threaded ends of the two crossbars extending at either side stile and is positioned against the flat spacer plates 15. The attachment device 10 also includes U-shaped clamps 16 to be fitted over the threaded ends of the crossbars 13 which clamp the elongated member 5 to the side stile 3. The U-shaped clamp 16 is so dimensioned as to embrace the elongated member 5 and at least partially overlap the side stile 3.

In the preferred embodiment, as best shown in FIG. 1, two crossbars are provided to extend through the rungs of the ladder at about three steps apart. In this embodiment, the elongated member 5 is about 6' high and 2¾" wide. The vertical bars defining the elongated member 5 are spaced apart about ¾" to form the slot 11 which is adapted to receive crossbars which are standard threaded bolts having a length of about 22" and a diameter of about ⅝". The securing means of the present invention also include a set of nut washers, having a ⅝" diameter suitable to engage the threaded bolts. Preferably wing nuts may be used to facilitate tightening. The flat spacers are 3" by 2", and the U-shaped clamps are about 4½" wide and 1½" deep. The stile extending device is made of a material similar to that of the ladder, preferably, some sort of lightweight metal.

Although in the preferred embodiment, two crossbars 13 are used, it is possible to provide only one crossbar 13 which, together with the U-shaped clamp 16, will securely and rigidly connect the elongated member 5 to the side stile 3 and retain in alignment therewith.

The present invention device is very simple in structure and can be very easily mounted on the ladder. The two crossbars are inserted through the rungs of the ladder, preferably about 2 or 3 rungs apart. The spacer plates are then inserted over the threaded ends of the crossbars and are positioned to lay against the side stiles. The elongated member is then inserted through the slot crossbars at the side stile which is to be extended and the length of the extension is adjusted along the slot. The clamping members are then provided for clamping the elongated member to the ladder stile. Finally, the nuts are tightened at both ends of the cross members to provide secure mounting of the attachment device to the ladder.

While a preferred embodiment of the present invention has been illustrated and described, it will be appreciated that various changes can be made therein without departing from the spirit and scope of the present invention.

I claim:

1. An attachment device for use interchangeably with ladders having two side stile members with a substantially I-shaped cross section and a plurality of hollow rungs connected therebetween for extending at least one of said side stile members so that the ladder can be used on uneven ground, said attachment device comprising:

an elongated, substantially flat bar member provided with a longitudinal slot extending lengthwise therethrough;

mounting means for adjustably attaching said elongated flat bar member to an outer surface of one of said side stile members, said mounting means including two crossbars adapted to fit through said slot in said elongated member and to extend through any two of said hollow rungs;

securing means including threaded means provided at least at said opposite ends of said crossbars and a pair of nuts fitting over said threaded means for tightening said elongated flat bar member to said outer surface of said stile member;

a pair of spacer plates substantially the same width as an interior portion of said I-shaped stile members for each of said crossbars insertable at said opposite ends to be positioned against said outer surface of said side stile members adjacent to the hollow rungs in which said crossbars are inserted;

a pair of U-shaped clamping members extending over the sides of said side stile members adjacent to each of said crossbars for clamping said elongated member to said outer surface of said side stile member.

2. An attachment device for use interchangeably with ladders having two side stile members with a substantially I-shaped cross section and a plurality of hollow rungs connected therebetween for extending at least one of said side stile members so that the ladder can be used on uneven ground, said attachment device comprising:

an elongated, substantially flat bar member provided with a longitudinal slot extending lengthwise therethrough;

mounting means for adjustably attaching said elongated member to an outer surface of one of said side stile members, said mounting means including two crossbars adapted to fit through said slot in said elongated flat bar member and to extend through any two of said hollow rungs;

securing means including threaded means provided at said opposite ends of said crossbars and a pair of nuts fitting over said threaded means for tightening said elongated flat bar member to said outer surface of said stile member;

a pair of U-shaped clamping members attachable to said threaded means and extending over the sides of said of elongated flat bar member and of said side stile members adjacent to each of said crossbars for clamping said elongated member, upon assembly, to said outer surface of said side stile member.

* * * * *